US006079998A

United States Patent [19]

Kamath

[11] Patent Number: 6,079,998

[45] Date of Patent: Jun. 27, 2000

[54] LOW INSERTION FORCE CONNECTOR WITH GEAR DRIVEN CAMS

[75] Inventor: Shashidhar M. Kamath, Belleville, Mich.

[73] Assignee: Yazaki North America, Inc., Canton, Mich.

[21] Appl. No.: 09/221,812

[22] Filed: Dec. 29, 1998

[51] Int. Cl.[7] ..... H01R 13/15

[52] U.S. Cl. ..... 439/259

[58] Field of Search ..... 439/259, 122, 439/197, 252, 261, 263, 71, 75, 74, 264, 268, 912

[56] References Cited

U.S. PATENT DOCUMENTS

| | | | |
|---|---|---|---|
| 3,848,221 | 11/1974 | Lee, Jr. . | |
| 4,176,900 | 12/1979 | Hines et al. . | |
| 4,370,011 | 1/1983 | Suzuki et al. | 439/264 |
| 4,778,395 | 10/1988 | Narita | 439/71 |
| 5,496,186 | 3/1996 | Dobbelaere et al. | 439/157 |
| 5,721,669 | 2/1998 | Becker et al. | 361/685 |
| 5,961,344 | 10/1999 | Rosales et al. | 439/495 |

*Primary Examiner*—Lincoln Donovan
*Assistant Examiner*—Chandrika Prasad
*Attorney, Agent, or Firm*—Young & Basile, P.C.

[57] ABSTRACT

A first connector has a series of movable terminals having bifurcated ends comprising first and second prongs spaced apart from one another and a pair of parallel, rotatable cam members disposed on either side of the first prongs to sandwiching them therebetween. The cam members are elliptical in cross section and are connected with one another by intermeshing gears to rotate in unison. A second connector has a series of fixed terminals and a pair of actuation arms extending parallel with the terminals and having toothed ends. As the first and second connectors are moved into engagement with one another, the fixed terminals are inserted between the first and second prongs and the toothed ends engage the gears, rotating the cam members so they deflect the movable terminals to bring the second prongs into contact with the fixed terminals. Contact between the two sets of terminals is delayed until the last few millimeters of travel of the first and second connectors as they are mated, thus substantially reducing the frictional resistance resulting from contact between the terminals.

12 Claims, 3 Drawing Sheets

LOW INSERTION FORCE CONNECTOR WITH GEAR DRIVEN CAMS

FIELD OF THE INVENTION

This invention relates in general to multi-pin electrical connectors and more specifically to an electrical connector assembly in which the amount of force required to insert two mating connectors into engagement with one another is greatly reduced.

BACKGROUND OF THE INVENTION

As the number and complexity of electrical circuits in modern automobiles has increased, electrical connectors having large numbers of terminals have become more common. It is not unusual for a single electrical connector to contain 32 individual terminals. In conventional electrical connectors, the movement of a pair of connectors into engagement with one another causes male and female terminals housed in the respective connectors to slide into contact with one another. A certain degree of normal force between the terminal contact surfaces is required for good electrical conductivity between the terminals, resulting in a relatively high level of frictional resistance to insertion of the mating terminals into engagement with one another. The greater the number of terminals in a connector, the greater the total force required to overcome this resistance to engagement of the connectors. Connectors having a large number of terminals may be so difficult to mate that to do so by hand, as is often required in a production line environment, is quite difficult.

Most electrical connectors include some type of latching mechanism for holding the two connectors in mated engagement with one another. This generally takes the form of a spring latch arrangement which further adds to the amount of resistance to inserting the two connectors into engagement with one another.

This high insertion force problem has been dealt with in the past by connector assemblies which employ a two-step connector mating operation. In such an assembly, the first step involves moving the connector bodies which house the terminals into mating engagement with one another, but the male and female terminals are positioned within the bodies such that the terminals themselves do not yet make contact with one another. In the second step, a button, lever, or switch is actuated to move one or the other, or both, of the sets of terminals relative to their connectors to bring the terminals into physical and electrical contact. This procedure has the obvious drawback of requiring two separate actions on the part of the person or machine making the connection, thus making the assembly process more complicated and time consuming.

It is known to provide mating connectors with cam-type means which deflect a first set of terminals into contact with mating terminals as the two connectors are inserted into engagement with one another. See, for example, U.S. Pat. No. 4,176,900.

It would be desirable to provide an electrical connector assembly in which first and second mating connectors may be inserted into engagement with one another without a large amount of insertion force and without requiring a secondary mating operation.

SUMMARY OF THE INVENTION

It is an object of this invention to provide a low insertion force connector assembly which can be used to advantage with connectors accommodating large numbers of terminals.

Another object of this invention is to reduce or eliminate the frictional forces between male and female terminals during mating of their respective electrical connectors.

A further object of this invention is to provide a simple, inexpensive connector mechanism for bringing terminals into electrical contact with one another without a secondary mating operation.

The invention connector assembly includes first and second connectors having respective first and second sets of electrical terminals disposed therein. At least one cam member is rotatably mounted to the first connector adjacent the first terminals such that as it rotates it contacts the terminals and urges them sideways to a deflected position. As the connectors are moved into mating engagement with one another, the second terminals are inserted into overlapping relationships with respective first terminals, and an actuation member disposed on the second connector engages the cam member and causes it to rotate such that the first terminals are urged sideways into contact with the second terminals. As the first and second connectors are withdrawn from mating engagement, the actuation member rotates the cam member in the opposite direction such that the first terminals move away from the second terminals. In this fashion, contact between the first and second terminals is delayed until the last few millimeters of travel of the first and second connectors as they are mated, thus substantially reducing the frictional resistance resulting from contact between the terminals.

According to another feature of the invention, the first terminals have bifurcated ends comprising first and second prongs spaced apart from one another, and a pair of cam members are disposed on either side of the first prong, sandwiching it therebetween. The cam members are connected with one another to rotate in unison, and as they do so they deflect the terminals so that the second prongs make contact with the respective second terminals.

In a preferred embodiment of the invention, the first and second cam members have gears disposed at either end which mesh with one another to ensure that the cam members rotate in unison, and actuation members are disposed at opposite sides of the second connector and comprise racks which engage respective gears at opposite ends of the cam members.

DETAILED DESCRIPTION OF THE PREFERRED EMBODIMENT

Figure 1:
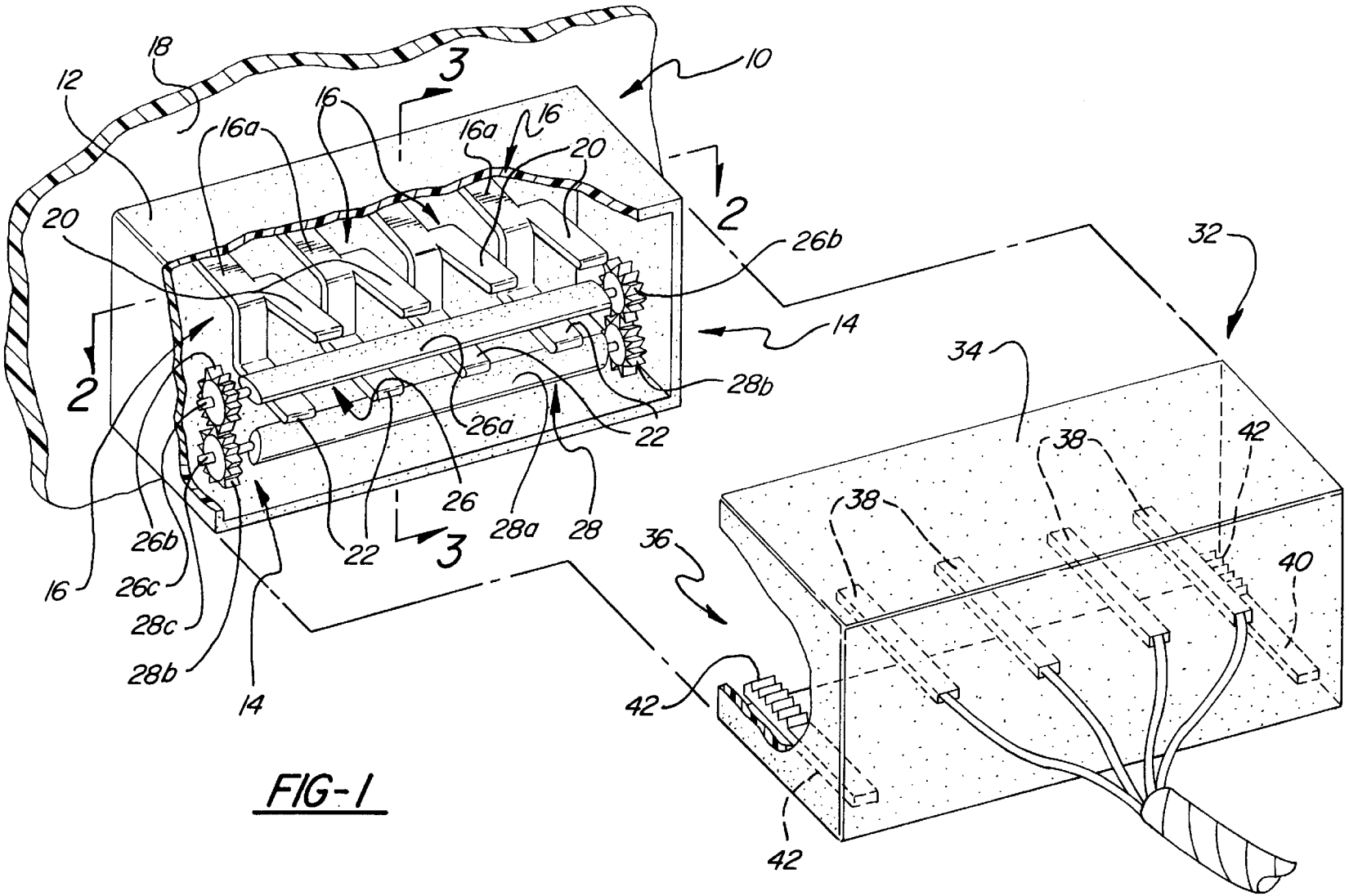
FIG. 1 is a cut-away perspective view of first and second connectors according to the present invention.
Figure 2:
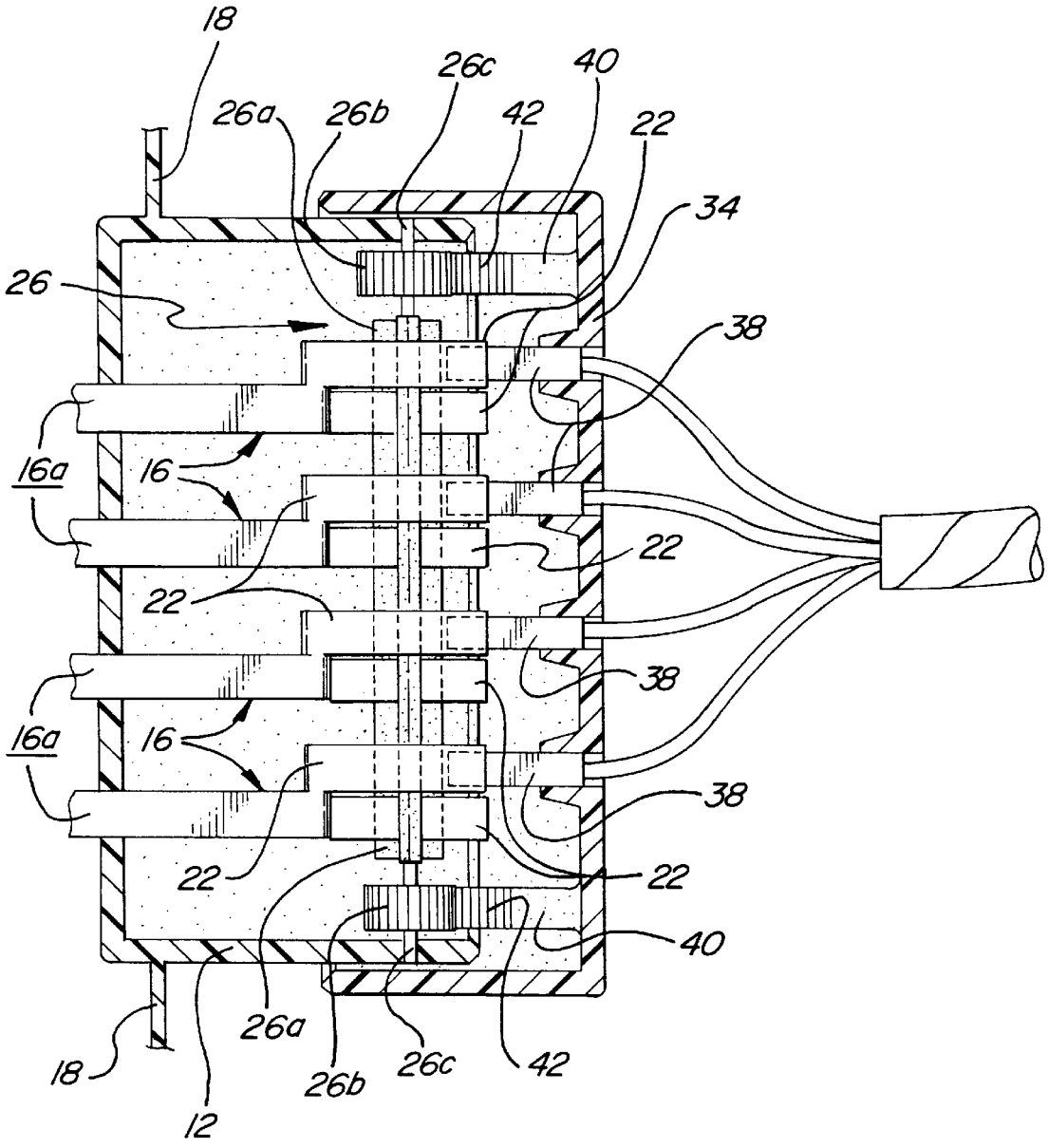
FIG. 2 is a cross-sectional view taken along line 2—2 of FIG. 1, with the first and second connectors in a mated condition.

Referring now to FIGS. 1–4, a first connector 10 comprises a plastic housing 12 of substantially rectangular exterior configuration and having an open mating end 14. A plurality of metal terminals 16 are disposed within the first connector 10 in a straight line across the width thereof. The terminals 16 have bifurcated forward ends oriented toward the mating end 14 of the connector and stems 16a which extend through a rear wall of the connector where they make electrical connection with wires or other conventional electrically conductive means (not shown). The first connector 10 is shown mounted on a panel 18, but the present invention may be practiced with other types of connectors such as those which terminate wire harnesses.

Figure 3:
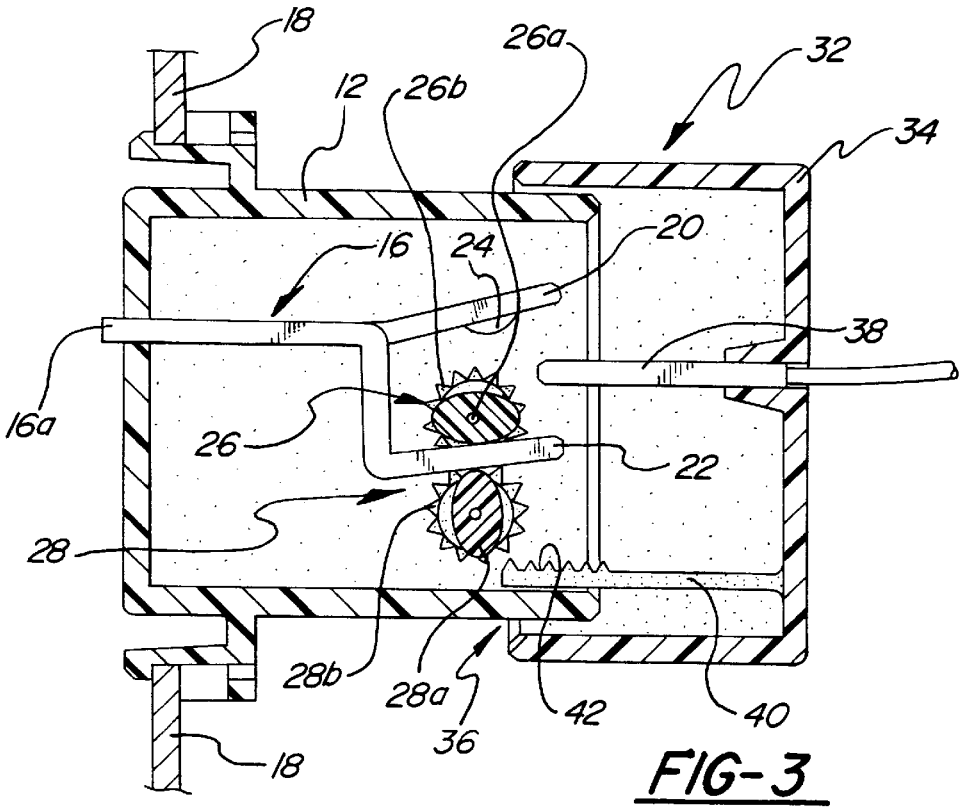
FIG. 3 is a cross-sectional view taken along line 3—3 of FIG. 1 with the connectors in a pre-mated position.
Figure 4:
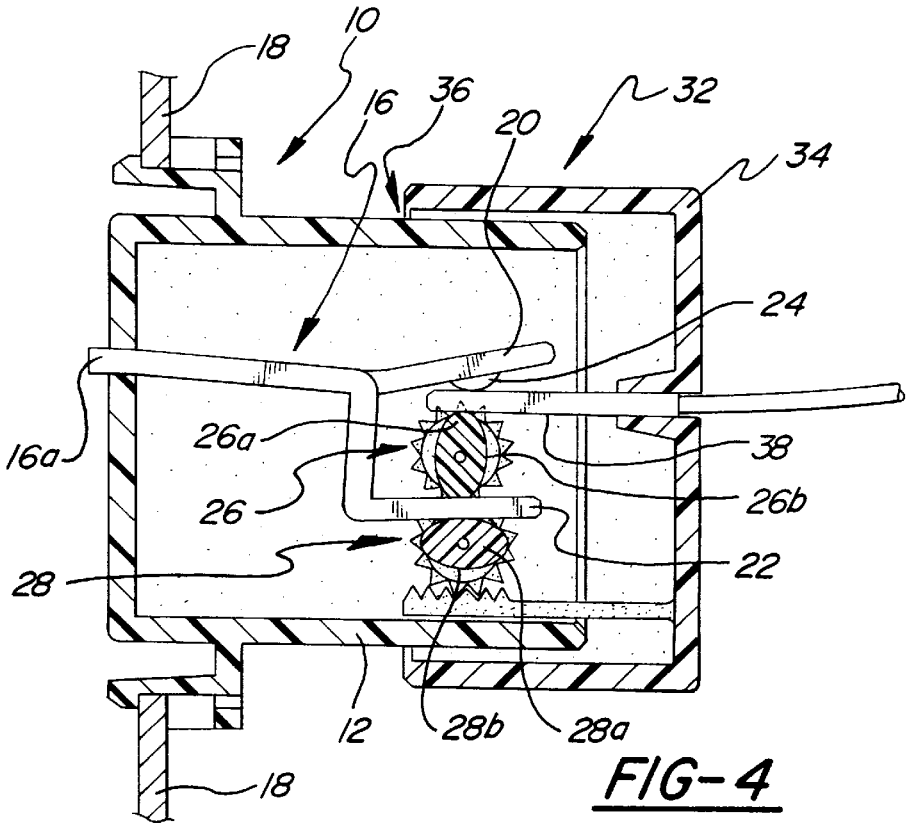
FIG. 4 is a cross-sectional side view similar to that of FIG. 3, but with the connectors in a mated condition.

The bifurcated end of each terminal 16 comprises an upper prong 20 and a lower prong 22. The terminals 16 may be economically fabricated by stamping a strip of sheet metal to have a Z-shaped bend which forms the lower prong 22, while the upper prong 20 extends generally straight out from the stem 16*a* and is attached thereto at a common edge. As a result of this forming method, the prongs 20,22 are offset horizontally from one another by a small amount. As best seen in FIGS. 3 and 4, the upper prong 20 may extend upwardly at an angle from the terminal stem 16*a* as necessary to achieve the correct spacing between the prongs. The upper prongs 20 have contact bumps 24 protruding from the lower surfaces thereof adjacent their free ends.

Upper and lower deflecting members 26,28 respectively extend transversely across the width of the first connector 10 adjacent the mating end 14. Each deflecting member 26,28 comprises a cam member 26*a*,28*a* that is generally elliptical or oblong in cross-section, gears 26*b*,28*b* fixed to either end of the center section, and mounting pins 26*c*,28*c* projecting from the central axes of the gears. The mounting pins 26*c*,28*c* fit into holes in the side walls of the first connector 10 so that the cam members 26,28 are rotatable about parallel axes extending transversely between the side walls. The upper and lower deflecting members 26,28 are spaced apart from one another to pass immediately above and below the lower prongs 22, and the gears 26*b*,28*b* mesh with one another so that the cam members must rotate in unison. As best seen in FIG. 3, the gears 26*b*,28*b* mesh such that the elliptical cam member 26*a*,28*a* are 90° out of phase with one another at all times.

A second connector 32 comprises a plastic housing 34 of substantially rectangular exterior configuration and having an open mating end 36. A plurality of metal terminals 38 are disposed within the second connector 32 in a straight line across the width thereof and are equal in number and spacing to the terminals 16 of the first connector 10. A pair of drive arms 40 are disposed inside the housing 34 adjacent the lower corners thereof and extend parallel to the terminals 38. The upper surface of each arm 40 adjacent its free ends comprises a rack 42 made up of a plurality of parallel teeth. The drive arms 40 are preferably molded integrally with the housing 34.

Prior to mating of the first and second connectors 10,32, the major axis of the lower deflecting member 28 is oriented vertically and the major axis of the upper deflecting member 26 is oriented horizontally, as depicted in FIGS. 1 and 3. In this configuration, the deflecting members 26,28 are spaced from one another by a distance such that the lower prongs 22 just fit between them and the terminals 16 are in an undeflected condition.

As the first and second connectors 10,32 are mated with one another, the second connector housing 34 fits over and around the first connector housing 12 and the second connector terminals 38 extend between the upper and lower prongs 20,22 of the respective first connector terminals 16. The drive arms 40 slide into the mating end 14 of the first connector 10 and pass immediately below the lower deflecting member gears 28*b* such that the racks 42 engage the lower deflecting member gears and cause them to rotate. As the connectors 10,32 are moved to the fully mated condition shown in FIG. 4, the upper and lower deflecting members 26,28 rotate through 90° such that the major axis of the lower deflecting member 28 is oriented horizontally and the major axis of the upper deflecting member 26 is oriented vertically, thus urging the lower prongs 22 downwardly. This causes the terminals 16 to bend or deflect downwardly such that the upper prongs 20 come into contact with the second connector terminals 38.

When the deflecting members 26,28 are rotated to this fully mated position, the lower prongs 22 are held securely between the upper and lower deflecting members 26,28 and the second connector terminals 38 are held securely between the upwardly facing edge of the upper deflecting member 26 and the bumps 24 of the upper prongs 20. Accordingly, both the upper and lower prongs 20,22 are supported by the deflecting members 26,28 to ensure proper positioning and resist any movement that may be caused by vibration during use.

When the first and second connectors 10,32 are withdrawn from mated engagement with one another, the racks 42 move relative to the lower deflecting member gears 28*b* such that the deflecting members 26,28 rotate back to the configuration shown in FIG. 3, thus urging the terminals 16 back to their undeflected positions and so breaking contact with the second connector terminals 38.

As is apparent from the foregoing description, the present invention reduces the amount of insertion force required to mate the two connectors because there is no sliding contact between the mating terminals 16,38 as the connectors are moved into engagement with one another, and therefore there is no frictional force to overcome during the mating procedure. No separate, second actuation step is required to bring the male and female connectors into contact with one another.

While the invention has been described in connection with what is presently considered to be the most practical and preferred embodiment, it is to be understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

The invention claimed is:

1. A connector assembly comprising:

first connector having a plurality of movable terminals disposed thereon;

a second connector having a plurality of fixed terminals, the second connector matingly engagable with the first connector;

deflecting member rotatably mounted on the first connector for deflecting the movable terminals; and member disposed on the second connector for engaging and rotating the deflecting member as the first and second connectors are matingly engaged with one another, said rotation of the deflecting means urging the movable terminals into contact with respective fixed terminals.

2. A connector assembly according to claim 1 wherein at least one of the movable terminals has a bifurcated end comprising first and second prongs spaced apart from one another, the first prong for being acted upon by the deflecting member and the second prong for making contact with the respective fixed terminal.

3. A connector assembly according to claim 1 wherein the deflecting member comprises a deflecting member having at least one gear and the rotating means comprises a rack engagable with the gear to rotate the deflecting member.

4. A connector assembly according to claim 1 wherein the deflecting member comprises first and second deflecting members sandwiching the movable terminals therebetween, the first and second deflecting members engaged with one another for simultaneous rotation between a first condition wherein the cam members urge the movable terminals toward the fixed terminals in response to insertion of the first and second connectors into mating engagement with one another and a second condition wherein the cam members urge the movable terminals away from the fixed terminals in response to withdrawal of the first and second connectors from said mating engagement.

5. A connector assembly according to claim 4 wherein the first and second cam members each comprise at least one gear, the first and second cam member gears in meshing engagement with one another.

6. A connector assembly according to claim 5 wherein the first and second cam members extend in parallel between first and second sides of the first connector, and each of the cam members have first and second gears disposed at either end thereof adjacent the respective first and second sides of the first connector, the first gears meshingly engaged with one another and the second gears meshingly engaged with one another.

7. A connector assembly according to claim 5 wherein the rotating means comprises a rack engagable with at least one of the gears.

8. A connector assembly according to claim 4 wherein at least one of the movable terminals has a bifurcated end comprising first and second prongs spaced apart from one another, the first cam member disposed between the first prong and the second prong and the second cam member disposed adjacent a side of the first prong opposite the first cam member such that the first and second cam members sandwich the first prong therebetween, and the second prong contacting the fixed terminal when the first and second connectors are in mating engagement.

9. A connector assembly according to claim 1 wherein the deflecting member comprises a cam member extending between first and second sides of the first connector and having an oblong cross section, and the movable terminals are disposed in a line parallel with the cam member.

10. A connector assembly comprising:

a first connector having at least one movable terminal disposed thereon, the movable terminal having a bifurcated end comprising spaced apart first and second prongs;

a second connector matingly engagable with the first connector and having at least one fixed terminal disposed thereon; and means for contacting the first prong as the first and second connectors are matingly engaged with one another and urging the movable terminal such that the second prong contacts the fixed terminal.

11. A connector assembly according to claim 10 wherein the means for contacting the movable terminal prong comprises at least one cam member rotatably mounted on the first connector and at least one actuation member disposed on the second connector, the actuation member engaging the cam member and urging it into contact with the first prong when the first and second connectors are matingly engaged with one another.

12. A connector assembly comprising:

a first connector having opposite first and second side walls and a plurality of movable terminals disposed in a substantially straight line therebetween, each of the movable terminals having a bifurcated end comprising first and second prongs spaced apart from one another;

a second connector having opposite first and second side walls and a plurality of fixed terminals disposed therebetween, the second connector matingly engagable with the first connector to insert the fixed terminals between the prongs of respective movable terminals;

a first cam member rotatably mounted to and extending between the side walls of the first connector and disposed between the first prongs and the second prongs, the first cam member having first and second gears adjacent either end;

a second cam member rotatably mounted to and extending between the side walls of the first connector adjacent a side of the first prongs opposite the second prongs such that the first and second cam members sandwich the first prongs therebetween, the second cam member having first and second gears adjacent either end meshingly engaged with respective first and second gears of the first cam member such that the cam members rotate in unison between a first condition wherein the cam members urge the movable terminals such that the second prongs contact the fixed terminals and a second condition wherein the cam members urge the movable terminals away from the fixed terminals; and at least one cam actuation member disposed on the second connector and having a rack portion for engagement with at least one of the gears when the first and second connectors are in mating engagement with one another, said engagement between the rack portion and the at least one gear rotating the cam members toward the first condition as the first and second connectors are moved into mating engagement with one another and toward the second condition as the first and second connectors are withdrawn from said mating engagement.

* * * * *

UNITED STATES PATENT AND TRADEMARK OFFICE

CERTIFICATE OF CORRECTION

PATENT NO. : 6,079,998
DATED : June 27, 2000
INVENTOR(S) : Kamath

It is certified that error appears in the above-identified patent and that said Letters Patent is hereby corrected as shown below:

Abstract,
Line 5, delete "sandwiching" and insert -- sandwich --

Column 3,
Line 34, change "member" to -- members --

Column 4,
Line 47, before "first connector" add -- a --
Line 52, before "deflecting member" add -- a --
Line 54, change "member" to -- means --
Line 57, change "means" to -- member --
Line 67, change "deflecting" (second occurrence) to -- cam --

Column 5,
Line 2, change "deflecting" to -- cam --
Line 4, change "deflecting" (second occurrence) to -- cam --
Line 6, change "deflecting" to -- cam --

Signed and Sealed this

Twenty-fifth Day of September, 2001

*Attest:*

Nicholas P. Godici

NICHOLAS P. GODICI
*Acting Director of the United States Patent and Trademark Office*

*Attesting Officer*